US006402409B1

(12) United States Patent
Park

(10) Patent No.: US 6,402,409 B1
(45) Date of Patent: Jun. 11, 2002

(54) RETRACTABLE TIP WRITING IMPLEMENT WITH TIP PROTECTING MEMBER

(76) Inventor: Young-Saeng Park, 1-602, Byucksan Green Villa, Jangjean-dong, Gumjung-ku, Pusan (KR)

( * ) Notice: Subject to any disclaimer, the term of this patent is extended or adjusted under 35 U.S.C. 154(b) by 0 days.

(21) Appl. No.: 09/963,475

(22) Filed: Sep. 27, 2001

(30) Foreign Application Priority Data

Sep. 29, 2000 (KR) ..... 00/57359

(51) Int. Cl.[7] ..... B43K 24/02; B43K 5/16; B43K 7/12

(52) U.S. Cl. ..... 401/107; 401/108

(58) Field of Search ..... 401/99, 107, 108, 401/103, 109

(56) References Cited

U.S. PATENT DOCUMENTS 4,479,732 A * 10/1984 Shimizu ..... 401/107

FOREIGN PATENT DOCUMENTS

KR 20-0172486 12/1999

* cited by examiner

*Primary Examiner*—David J. Walczak
*Assistant Examiner*—Tuan Nguyen
(74) *Attorney, Agent, or Firm*—Robert E. Bushnell, Esq.

(57) ABSTRACT

A retractable tip writing implement according to the present invention includes a tip protecting member removably mounted in an opening formed in the body of the retractable tip writing implement. The tip protecting member serves to prevent drying of ink and to protect the end of the tip and of the writing implement. The tip protecting member may be made of a material with excellent chemical resistance and flexibility and includes a drawing unit for removing the tip protecting member through the opening, without disassembly of the front part of the body of the retractable tip writing implement.

21 Claims, 4 Drawing Sheets

RETRACTABLE TIP WRITING IMPLEMENT WITH TIP PROTECTING MEMBER

CLAIM FOR PRIORITY

This application makes reference to, incorporates the same herein, and claims all benefits accruing under 35 U.S.C. §119 arising from an application for "Appearing And Disappearing Type Writing Implement With Tip Protecting Member" earlier filed in the Korean Industrial Property Office on Sep. 29, 2000 and there duly assigned Serial No. 2000-57359.

FIELD OF THE INVENTION

The present invention relates to writing implements, in particular to retractable tip writing implements, and more particularly to a retractable tip writing implement with a tip protecting member.

DESCRIPTION OF THE RELATED ART

Generally, the tip of a writing stem arranged in the body of a retractable tip writing implement, such as a pen using aqueous ink, is always exposed to the atmosphere through an opening formed in the front part of the body of the writing implement. Consequently, the tip of the writing stem is exposed to the atmosphere for a long time in the course of the distribution of the writing implement, and thus the ink at the end of the tip dries up. As a result, it may be impossible for a user to write with the retractable tip writing implement because of the resulting poor transcription.

In one existing writing implement, the end of the tip of the writing stem has been coated with a tip protecting member by dipping of the end of the tip of the writing stem in the molten liquid of a wax containing a hardening agent in order to prevent drying of ink at the end of the tip.

However, when the end of the tip dipped in the molten liquid of the wax containing a hardening agent, the tip is heated by the molten liquid until the tip is taken out from the molten liquid. The ink in the interior of the tip may be deteriorated by the heat applied to the tip. And since the inner diameter of the tip is enlarged by the heat, in the case of a ball-point pen, a ball bearing mounted in the end of the tip may be separated from the tip. Furthermore, since the tip protecting member coated on the end of the tip adheres to the end of the tip with relatively great strength so as to seal the end of the tip, the ball bearing may be removed along with the tip protecting member when the tip protecting member is separated from the end of the tip.

Another tip protecting member is disclosed in Korean Utility Model Registration No. 172486, which is owned by the applicant of the present application, which is a tip protecting disc made of synthetic rubber and arranged in the interior of the front part of the body of the retractable tip writing implement in the form of a pad.

With such a tip protecting member, the tip of the writing stem penetrates into the flexible tip protecting member when the writing stem is inserted into the body of the retractable tip writing implement to seal the end of the tip, whereby the drying of ink and damage to the tip are prevented.

Since the tip protecting member is made in the form of a disc, however, it is difficult to mount the tip protecting member horizontally in the front part of the body of the retractable tip writing implement. Moreover, when the user removes the tip protecting member to use the retractable tip writing implement for the first time, it is essentially required that the front part be separated from the body of the writing implement for the user to remove the tip protecting member mounted in the front part of the body of the writing implement. Commonly, when the front part is separated from the body of the retractable tip writing implement, a spring arranged in the front part for biasing the writing stem may spring out unexpectedly, and as a result the spring may be lost.

SUMMARY OF THE INVENTION

It is an object to provide an improved tip protecting member able to protect a tip of a writing stem in a writing implement.

It is another object to provide a tip protecting member disposed within an inside of writing implement and extended from the inside to an outside of the writing implement.

It is also an object to provide a tip protecting member to be easily pulled out from an inside of a writing implement toward an outside of the writing implement.

Those and other objects may be achieved by providing an appearing and disappearing type writing implement equipped with tip protecting member removably mounted in an appearing and disappearing opening formed in a hollow tube body of the appearing and disappearing type writing implement for preventing dry of ink and for protecting the end of a tip of a writing stem disposed in the hollow tube body, the tip protecting member being made of a material with excellent chemical resistance and flexibility being removed from the hollow tube body without disassembly of a front part of the hollow tube body of the appearing and disappearing type writing implement.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Turning now to the drawings, the existing tip protecting members discussed above will now be discussed with reference to the drawings.

Figure 1:
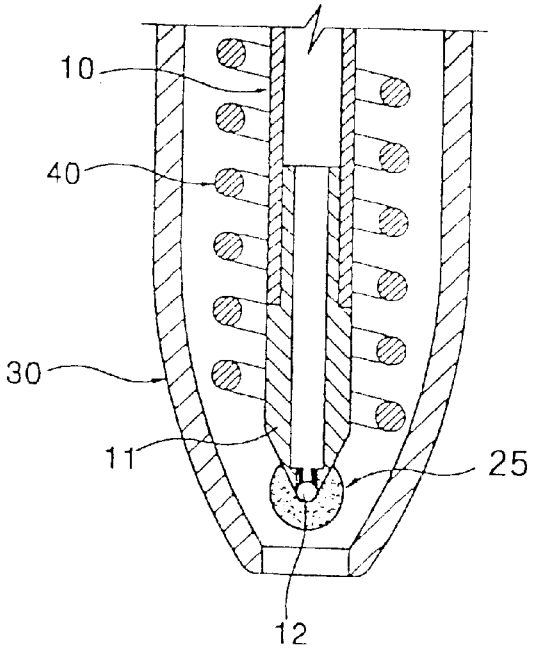
FIG. 1 and FIG. 2 are illustrative cross sectional views each showing a tip protecting member of a writing implement.

As shown in FIG. 1, the end of the tip 11 of the writing stem 10 has been coated with a tip protecting member 25 by dipping of the end of the tip 11 of the writing stem 10 in the molten liquid of a wax containing a hardening agent in order to prevent drying of ink at the end of the or tip.

However, when the end of the tip 11 dipped in the molten liquid of the wax containing a hardening agent, the tip 11 is heated by the molten liquid until the tip is taken out from the molten liquid. The ink in the interior of the tip 11 may be deteriorated by the heat applied to the tip. And since the inner diameter of the tip 11 is enlarged by the heat, in the case of a ball-point pen, a ball bearing 12 mounted in the end of the tip 11 may be separated from the tip 11. Furthermore, since the tip protecting member 25 coated on the end of the tip adheres to the end of the tip with relatively great strength so as to seal the end of the tip, the ball bearing 12 may be removed along with the tip protecting member 25 when the tip protecting member is separated from the end of the tip.

Figure 2:
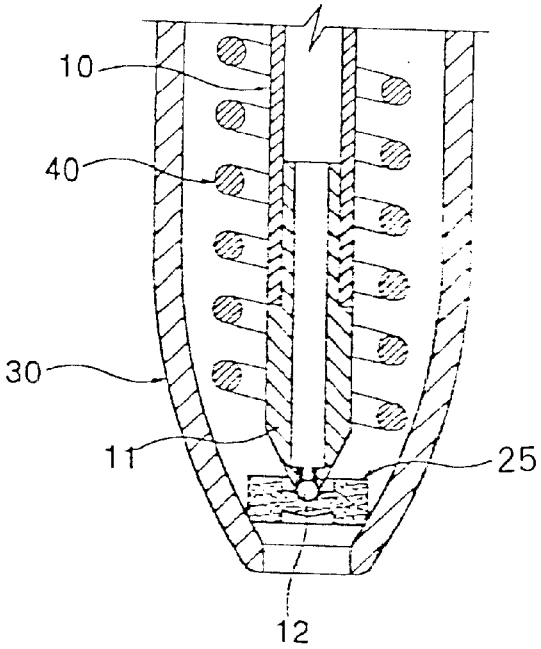

FIG. 2 illustrates the tip protecting member 25 disclosed in Korean Utility Model Registration No. 172486, which is a tip protecting disc made of synthetic rubber and arranged in the interior of the front part 30 of the body of the retractable tip writing implement in the form of a pad.

With such a tip protecting member, the tip 11 of the writing stem penetrates into the flexible tip protecting member 25 when the writing stem is inserted into the body of the retractable tip writing implement to seal the end of the tip, whereby the drying of ink and damage to the tip are prevented.

Since the tip protecting member is made in the form of a disc, however, it is difficult to mount the tip protecting member horizontally in the front part 30 of the body of the retractable tip writing implement. Moreover, when the user removes the tip protecting member 20 to use the retractable tip writing implement for the first time, it is essentially required that the front part 30 be separated from the body of the writing implement for the user to remove the tip protecting member 25 mounted in the front part of the body of the writing implement. Commonly, when the front part 30 is separated from the body of the retractable tip writing implement, a spring 40 arranged in the front part for biasing the writing stem 10 may spring out unexpectedly, and as a result the spring may be lost.

Figure 3:
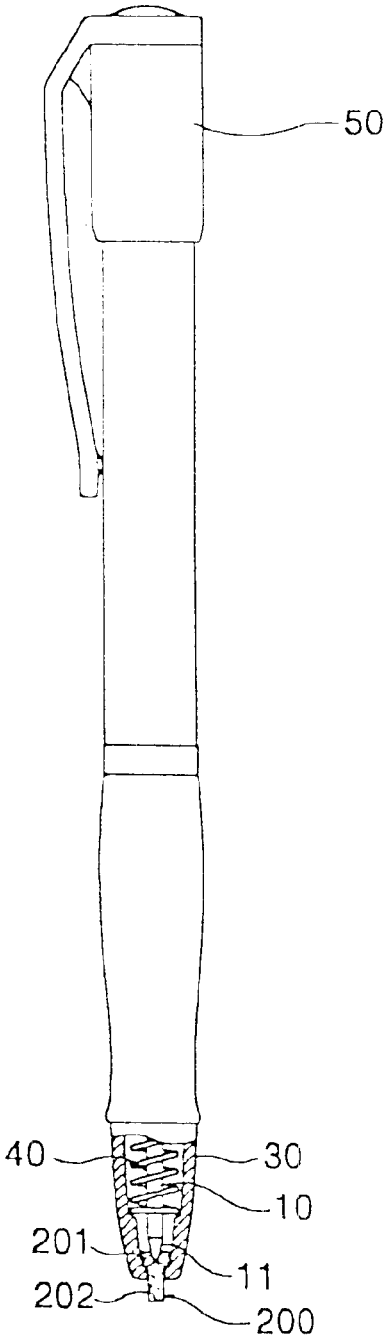
FIG. 3 is an illustrative perspective view, partially in section, of the entire construction of an appearing and disappearing type writing implement with a tip protecting member according to the present invention.
Figure 4:
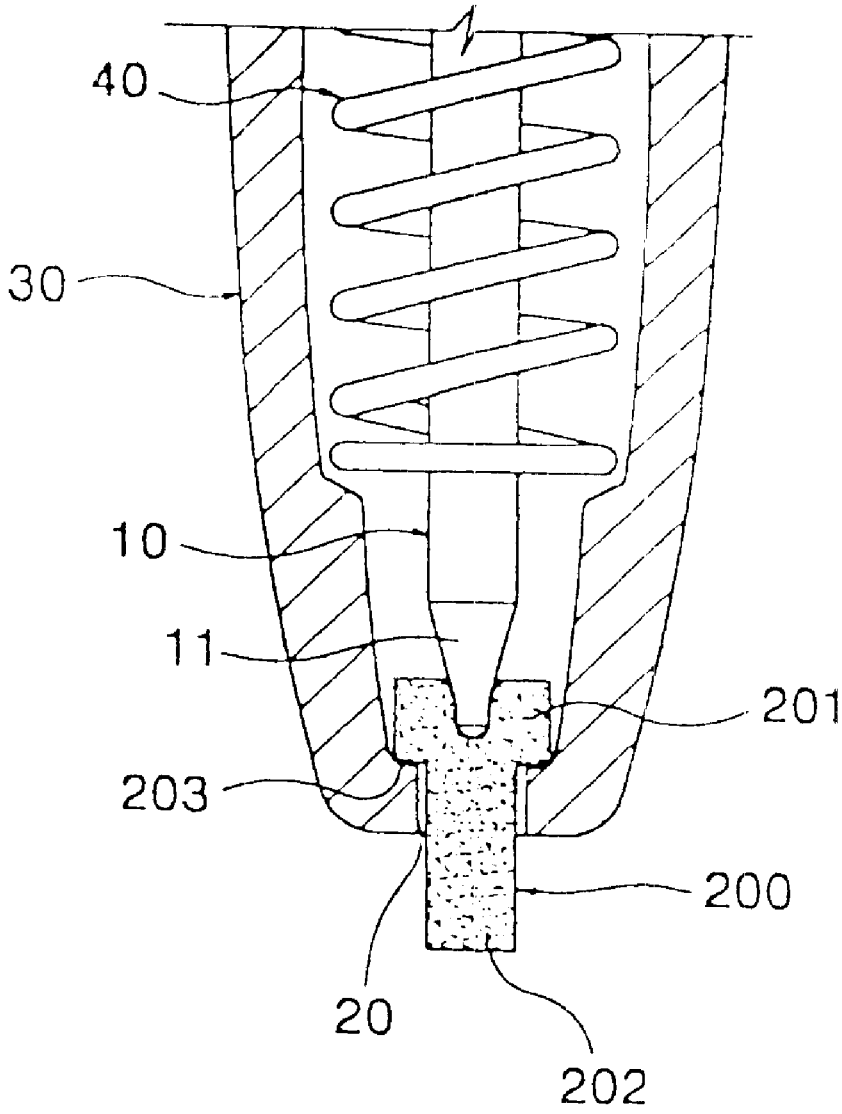
FIG. 4 is an enlarged cross sectional view showing the essential parts of the appearing and disappearing type writing implement with a tip protecting member according to the present invention.

The present invention will now be described with reference to the drawings. As shown in FIG. 3 and FIG. 4, there is a retractable tip writing implement in which a tip 11 of a writing stem 10 may appear or disappear (as the tip is extended or retracted) through an opening 20 formed in a front part 30 of the body of the retractable tip writing implement by means of the movement of a knob 50. Here, the term "knob" will generally refer to the mechanical part of the writing instrument which is moved to extend or retract the tip, and may take the form of a knob, pushbutton, slider, etc.

As shown in FIGS. 3 and 4, a tip protecting member 200 is mounted in the front part 30 of the body of the appearing and disappearing type writing implement. The tip protecting member is made of an elastomeric material, and is generally made of synthetic rubber with excellent chemical resistance, flexibility and contractibility. The tip protecting member 200 includes a head unit 201 which is inserted into the inner lower position of the front part 30 of the body of the retractable writing implement, with the end of tip 1 penetrating into the upper surface of head unit 201 so that the end of the tip is sealed. The head unit 201 has a hooking projection 203 around the lower surface of head unit 201, and a drawing grip unit 202 is formed integrally to the lower surface of said head unit 201. When installed in the retractable pen, the drawing grip unit is exposed to the atmosphere through opening 20 formed in a front part 30 of the body of the retractable tip writing implement. In the drawings, reference numeral 40 indicates a return spring of the writing stem 10.

In general, head unit 201 is round in shape and is of a greater diameter than drawing grip unit 202, which is also round. The underside of head unit 201 outside of the junction of drawing grip unit 202 forms hooking portion 203. The head unit 201 is thus generally of a size suitable for fitting inside of the inner lower position of the front part 30 of the body of a retractable writing implement. Drawing grip unit 202 is generally of a diameter which fits through the opening of a retractable writing implement. Although the size of head unit 201 and drawing grip unit 202 depends on the size of tip 1 and opening 20, the size of head unit 201 is in the range of 4.0 and 5.0 mm, and the size of drawing grip unit 202 is in the range of 2.5 and 3.5 mm.

Figure 5:
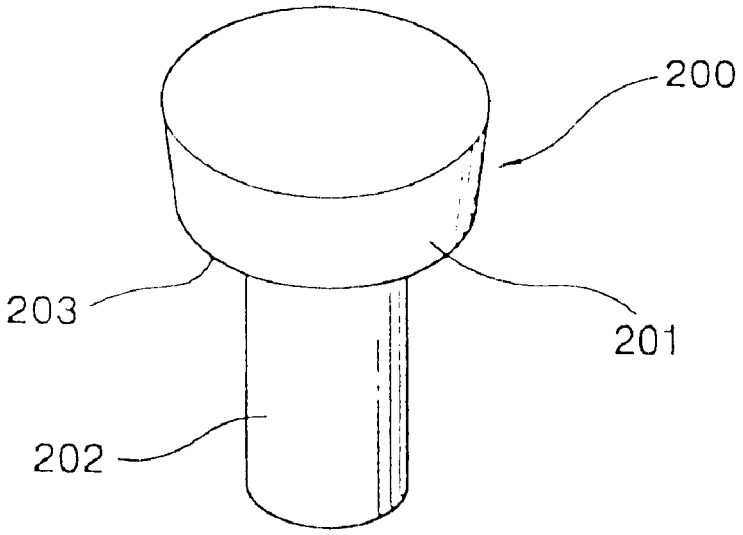
FIG. 5 and FIG. 6 are illustrative views showing other embodiments of the tip protecting member, which is an essential part of the appearing and disappearing type writing implement with a tip protecting member according to the present invention.

In one embodiment of the present invention as shown in FIG. 5, the head unit 201 is formed in such a way that the upper portion thereof is wide and the lower portion thereof is slightly narrow, that is, head unit 201 tapers toward the drawing grip unit, but the drawing unit is still narrower than the lower portion of the head unit. This taper helps to stabilize the head unit when mounted in the front body 30 of the body of the retractable tip writing implement. Head unit 210 has a shape of a frustum of a cone, and grip unit 202 is extended the lower portion of head unit 210.

Figure 6:
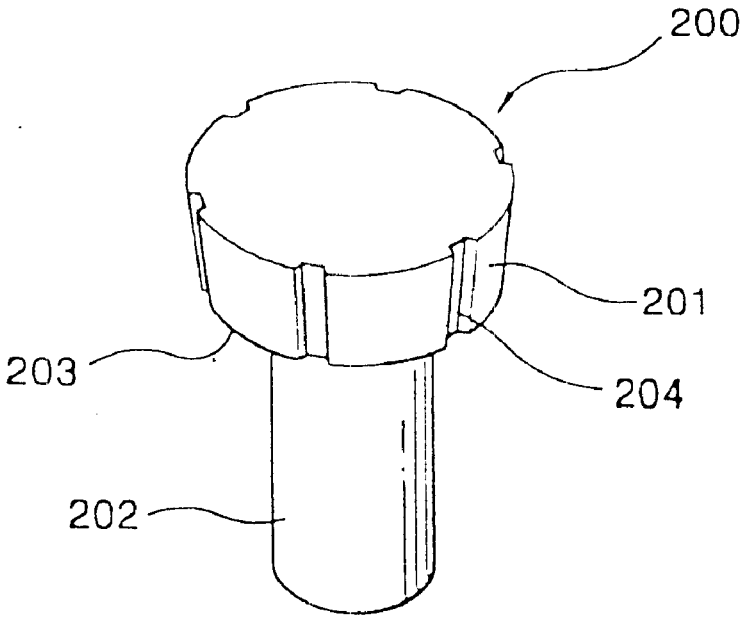

In another embodiment as shown in FIG. 6, grooves 204 are preferably formed around the head unit 201. These grooves allow the head unit to contract easily when the tip protecting member is drawn out from the inside of the front part 30 through opening 20 by force. Grooves 204 may be formed on a circumferential outer surface of the frustum of head unit 201 or a circumferential cylindrical surface of head unit 201.

According to the present invention, the tip protecting member 200 may be mounted in the front body 30 of the body of the retractable tip writing implement. When the tip protecting member 200 is mounted in the writing implement, the drawing grip unit 202 is exposed through the opening 20 formed in the front part 30 of the body of the retractable tip writing implement. The head unit 201 is inserted into the inner lower position of the front part 30 of the body of the retractable tip writing implement, and the head unit does not slip out of the front part 30 of the body of the retractable tip writing implement due to the hooking projection 203 around the lower surface of the head unit.

Under the condition as mentioned above, the front part 30 is joined to the body of the appearing and disappearing type writing implement having the spring 40 and the writing stem 10.

At this time, the writing stem 10 is subjected to pressure, with the tip 11 at the end of the writing stem penetrating into the upper surface of the head unit 201 of the tip protecting member 200 to seal the tip. Thereafter, the appearing and disappearing type writing implement with a tip protecting member according to the present invention is distributed for sale.

When the user buys and uses the retractable tip writing implement with a tip protecting member according to the present invention for the first time, the drawing grip unit 202, which is exposed to the atmosphere through opening 20 of the tip, is pulled out by force, and head unit 201, by virtue of its excellent flexibility and contractibility, is contracted and at the same time is removed through the opening 20 of the tip.

With the retractable tip writing implement with the tip protecting member 200, which includes the head unit 201 and the drawing grip unit 202, mounted in the front part 30 of the body of the retractable tip writing implement according to the present invention as described above, it is possible to prevent drying of the ink at the end of the tip and to prevent damage of the tip due to shock, since the end of the tip of the writing stem is sealed by the head unit 201. Moreover, the tip protecting member 200 can be removed easily by pulling out the drawing grip unit 202 when the retractable tip writing implement is used for the first time, and there is no need to separate the front part 30 from the body of the retractable tip writing implement. Furthermore, when the end of the front part of the body of the retractable tip writing implement is subjected to a shock in the course of distribution, the front end is protected against the shock since the drawing grip unit 202 extends from the front end.

What is claimed is:

1. A writing implement comprising:

a hollow tube body having an end portion, a hollow inside formed inside said end portion, and an opening formed on a distal end of said end portion and communicating with both said hollow inside and an outside of said hollow body, said opening having a first diameter less than a second diameter of said end portion;

a writing stem disposed within said hollow inside, having a tip formed on one end of said writing stem, said tip of said writing stem moving to a first position for protruding from said hollow tube body through said opening and a second position for retracting from said outside of said hollow tube body toward said hollow inside of said hollow tube body through said opening; and a tip protecting member made of an elastomeric material and having a head unit disposed within said hollow inside to cover said tip of said writing stem and a grip unit extended from said head unit and protruding from said hollow tube body through said opening and exposed to said outside of said body for allowing a user to grip said grip unit so as to pull said tip protecting member out from said end portion of said body through said opening.

2. The writing implement of claim 1, with said head unit of said tip protecting member having a third diameter greater that said first diameter of said opening and equal to or less than said second diameter of said end portion.

3. The writing implement of claim 2, wherein said third diameter of said head unit of said tip protecting member varies between said first diameter and said second diameter in order to pass through said opening when said tip protecting member is pulled out from said end portion of said hollow tube body through said opening.

4. The writing implement of claim 2, wherein said third diameter is greater than said first diameter when said head unit is disposed within hollow inside while said third diameter becomes less than said second diameter when said heat unit is pulled out from said hollow inside to said outside of said hollow tube body through said opening.

5. The writing implement of claim 1, with said head unit of said tip protecting member made of an elastic material and having a third diameter varying between said first and second diameter.

6. The writing implement of claim 1, with said head unit of said tip protecting member contacting said tip when said writing stem is in said second position.

7. The writing implement of claim 1, with said head unit of said tip protecting member disposed between said opening and said tip of said writing stem.

8. The writing implement of claim 1, with said grip unit of said tip protecting member having a thickness greater than a distance between said opening and said writing stem.

9. The writing implement of claim 1, with said head unit having a hole having a shape corresponding to said tip of said writing stem.

10. The writing implement of claim 1, with said grip unit of said tip protecting member having the a fourth diameter not greater than said first diameter of said opening.

11. The writing implement of claim 1, with said grip unit of said tip protecting member protruding from an outer surface of said hollow tube body through said opening by a predetermined distance.

12. The writing implement of claim 1, with said grip unit of said tip protecting member having a cylindrical shape fitting said opening.

13. The writing implement of claim 1, with said head unit and said grip unit both made of a single body in a monolithic structure.

14. The writing implement of claim 1, with said head unit comprising a groove formed on a circumferential outer surface of said head unit.

15. The writing implement of claim 1, with said head unit comprising a plurality of grooves formed on a circumferential outer surface of said head unit, wherein said grooves having a depth less than a difference between said first diameter and said second diameter.

16. A writing implement comprising:

a body having an end portion, a hollow inside formed inside said end portion, and an opening formed on a distal end of said end portion and communicating with said hollow inside and an outside of said body, said opening having a first diameter less than a second diameter of said end portion;

a writing stem disposed within said hollow inside, having a tip formed on one end of said writing stem, said tip of said writing stem moving a first position for protruding from said body through said opening and a second position for retracting from said outside of said body toward said hollow inside of said body through said opening; and a tip protecting member made of an elastomeric material and having a head unit disposed within said hollow inside to cover said tip of said writing stem, said head unit having a shape of a frustum of a cone, said tip protecting member having a grip unit extended from said head unit and protruding from said body through said opening and exposed to said outside of said body for allowing a user to grip said grip unit so as to pull said tip protecting member out from said end portion of said body through, said opening.

17. The writing implements of claim 16, with said frustum of said head unit of said tip protecting member including a first surface and a second surface opposite to said first surface, said first surface having a first diameter greater that a second diameter of said second surface and facing said tip of said writing stem while said second surface faces said opening.

18. The writing implements of claim 17, wherein said second diameter of said second surface is equal to or greater than said opening.

19. The writing implements of claim 17, with said grip unit extended from said second surface of said frustum of said head unit of said tip protecting member.

20. The writing implements of claim 17, further comprising a groove formed on a circumferential surface of said frustum of said head unit of said tip protecting member.

21. The writing implements of claim 16, wherein the size of grip unit being in the range of 2.5 mm and 3.5 mm while the size of said head unit is in the range of 4.0 mm and 5.0 mm.

* * * * *